US008223176B2

(12) United States Patent
Jeon et al.

(10) Patent No.: US 8,223,176 B2
(45) Date of Patent: Jul. 17, 2012

(54) DISPLAY DEVICE AND METHOD OF DRIVING THE SAME

(75) Inventors: Jee-Hoon Jeon, Hwaseon-si (KR); Kwan-Young Oh, Anyang-si (KR); Hyoung-Sik Nam, Incheon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 600 days.

(21) Appl. No.: 12/468,539

(22) Filed: May 19, 2009

(65) Prior Publication Data

US 2010/0020112 A1 Jan. 28, 2010

(30) Foreign Application Priority Data

Jul. 28, 2008 (KR) ..... 10-2008-0073554

(51) Int. Cl.
*G09G 5/10* (2006.01)

(52) U.S. Cl. ..... 345/690; 345/87; 345/88; 345/89

(58) Field of Classification Search ..... 345/87, 345/88, 89, 99, 690
See application file for complete search history.

(56) References Cited

U.S. PATENT DOCUMENTS

| | | | | |
|---|---|---|---|---|
| 2003/0095090 | A1* | 5/2003 | Ham | 345/87 |
| 2004/0252111 | A1* | 12/2004 | Cheon et al. | 345/204 |
| 2005/0001802 | A1* | 1/2005 | Lee | 345/89 |
| 2007/0146394 | A1* | 6/2007 | Ahn | 345/690 |
| 2008/0284768 | A1* | 11/2008 | Yoshida et al. | 345/208 |
| 2009/0040167 | A1* | 2/2009 | Sun | 345/99 |
| 2009/0262124 | A1* | 10/2009 | Yamamoto et al. | 345/565 |

* cited by examiner

*Primary Examiner* — Amare Mengistu
*Assistant Examiner* — Koosha Sharifi-Tafreshi
(74) *Attorney, Agent, or Firm* — H.C. Park & Associates, PLC

(57) ABSTRACT

Provided are a display device, which can improve display quality by correcting an original image signal whose frame frequency is a first frequency or a second frequency different from the first frequency, and a method3 of driving the display device. The display device includes an image signal processor which corrects an original image signal whose frame frequency is a first frequency or a second frequency different from the first frequency and outputs a corrected image signal, a first lookup table which stores image correction data corresponding to an (n−1)-th frame and an n-th frame that corresponds to the original image signal having the first frequency, and a display panel which displays an image corresponding to the corrected image signal. A second lookup table, which corresponds to the original image signal having the second frequency, is generated from the first lookup table, and the first or second lookup table is selected based on the frame frequency of the original image signal to output the corrected image signal.

20 Claims, 11 Drawing Sheets

$$D(Gn)'=(1-FL/FH)*D(Gn-1)+(FL/FH)*D(Gn)$$

$$D(Gn)''=(1-FH/FL)*D(Gn-1)+(FH/FL)*D(Gn)$$

DISPLAY DEVICE AND METHOD OF DRIVING THE SAME

This application claims priority from and the benefit of Korean Patent Application No. 10-2008-0073554, filed on Jul. 28, 2008, which is hereby incorporated by reference for all purposes as if fully set forth herein.

BACKGROUND OF THE INVENTION

1. Field of the Invention

The present invention relates to a display device and a method of driving the same, and more particularly, to a display device, which includes an image signal processor correcting an original image signal whose frame frequency is a first frequency or a second frequency different from the first frequency and outputting a corrected image signal, and a method of driving the display device.

2. Discussion of the Background

A liquid crystal display (LCD) includes a first display panel having thin-film transistors (TFTs) and pixel electrodes, a second display panel having common electrodes, and a liquid crystal molecule layer interposed between the first and second display panels. The display quality of LCDs is affected by the response time of liquid crystal molecules. In order to reduce the response time of liquid crystal molecules, a method of comparing an image signal of a previous frame to that of a current frame and correcting the image signal of the current frame based on the comparison result has been suggested.

A method of inserting motion-compensated interpolated frames between original frames is also being developed in order to improve the display quality of LCDs. For example, LCDs may receive image information of 60 frames per second and display an image that corresponds to image information of 120 frames per second.

Therefore, an LCD that can reduce the response time of liquid crystal molecules and improve display quality by correcting an image signal having a variable frame frequency is desirable.

SUMMARY OF THE INVENTION

The present invention provides a display device which can improve display quality by correcting an original image signal whose frame frequency is a first frequency or a second frequency different from the first frequency.

The present invention also provides a method of driving a display device which can improve display quality by correcting an original image signal whose frame frequency is a first frequency or a second frequency different from the first frequency.

Additional features of the invention will be set forth in the description which follows, and in part will be apparent from the description, or may be learned by practice of the invention.

The present invention discloses a display device including an image signal processor which corrects an original image signal whose frame frequency is a first frequency or a second frequency different from the first frequency and outputs a corrected image signal, a first lookup table which stores image correction data corresponding to an (n−1)-th frame and an n-th frame that correspond to the original image signal having the first frequency, and a display panel which displays an image corresponding to the corrected image signal. A second lookup table, which corresponds to the original image signal having the second frequency, is generated from the first lookup table, and the first lookup table or second lookup table is selected based on the frame frequency of the original image signal, to output the corrected image signal.

The present invention also discloses a display device including an image signal processor which converts an original image signal, whose frame frequency is a first frequency or a second frequency different from the first frequency, into a transient image signal having a third frequency which is higher than the first and second frequencies, corrects the transient image signal, and outputs a corrected image signal. The display device also includes a first lookup table which stores image correction data corresponding to an (n−1)-th frame and an n-th frame of the original image signal having the first frequency, and a display panel which displays an image corresponding to the corrected image signal, wherein a second lookup table, which corresponds to the original image signal having the second frequency, is generated from the first lookup table, and the first lookup table or second lookup table is selected based on the frame frequency of the original image signal to output the corrected image signal.

The present invention also discloses a method of driving a display device. The method includes providing the display device including an image signal processor, which corrects an original image signal whose frame frequency is a first frequency or a second frequency different from the first frequency and outputs a corrected image signal, and a first lookup table which stores image correction data corresponding to an (n−1)-th frame and an n-th frame of the original image signal having the first frequency. The method also includes loading the first lookup table when the display device is powered on, generating a second lookup table, which corresponds to the original image signal having the second frequency, from the first lookup table, storing the second lookup table in an internal memory of the image signal processor, selecting the first lookup table or the second lookup table based on the frame frequency of the original image signal and generating the corrected image signal by using the selected lookup table, and displaying an image which corresponds to the corrected image signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
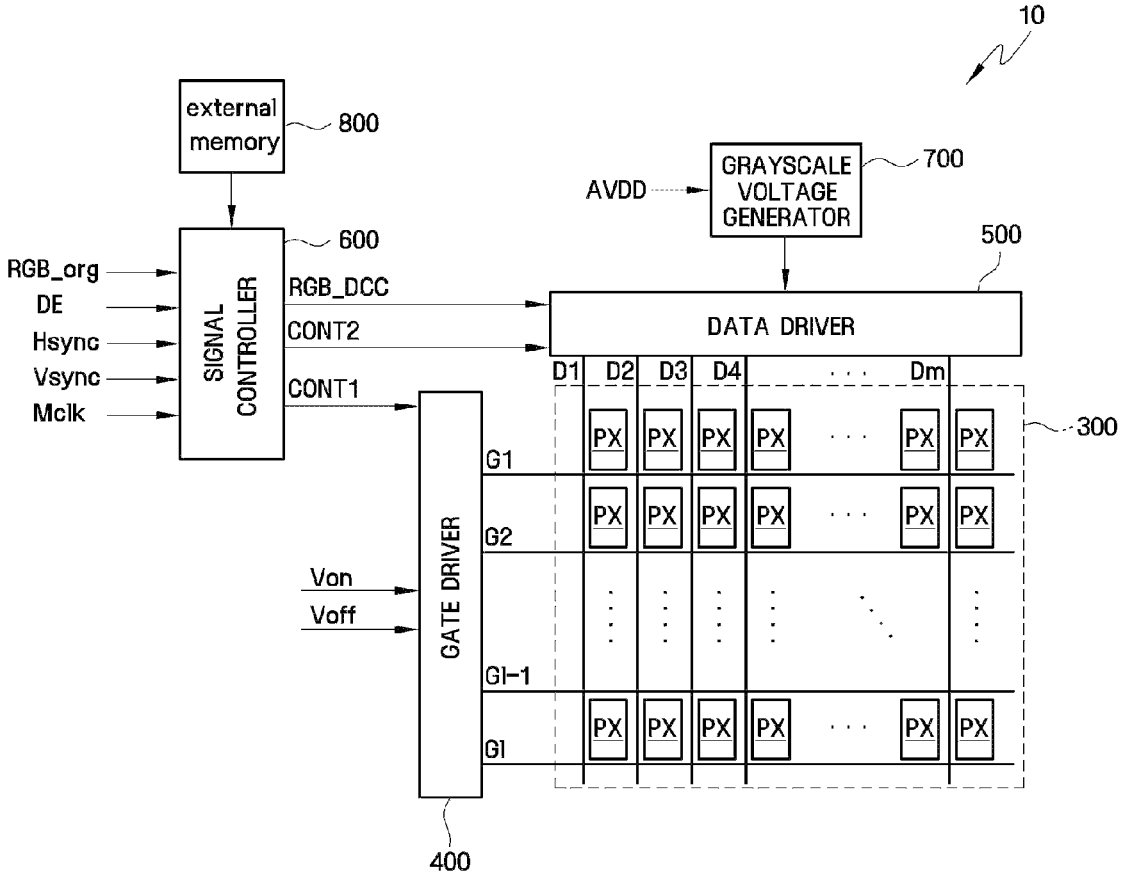
FIG. 1 is a block diagram for explaining a display device and a method of driving the same according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

It will be understood that, although the terms first, second, third, etc., may be used herein to describe various elements, components and/or sections, these elements, components and/or sections should not be limited by these terms. These terms are only used to distinguish one element, component or section from another element, component or section. Thus, a first element, component or section discussed below could be termed a second element, component or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated components, steps, operations, and/or elements, but do not preclude the presence or addition of one or more other components, steps, operations, elements, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, a display device according to an exemplary embodiment of the present invention will be described in detail with reference to the attached drawings. In the attached drawings, a previous frame, that is, an $(n-1)^{th}$ frame, is indicated by reference character frm_pre or frm(n−1), a current frame, that is, an $n^{th}$ frame, is indicated by reference character frm_cur or frm(n), and an interpolated frame which is inserted between the previous frame and the current frame is indicated by reference character frm_itp, where n is a natural number.

Figure 2:
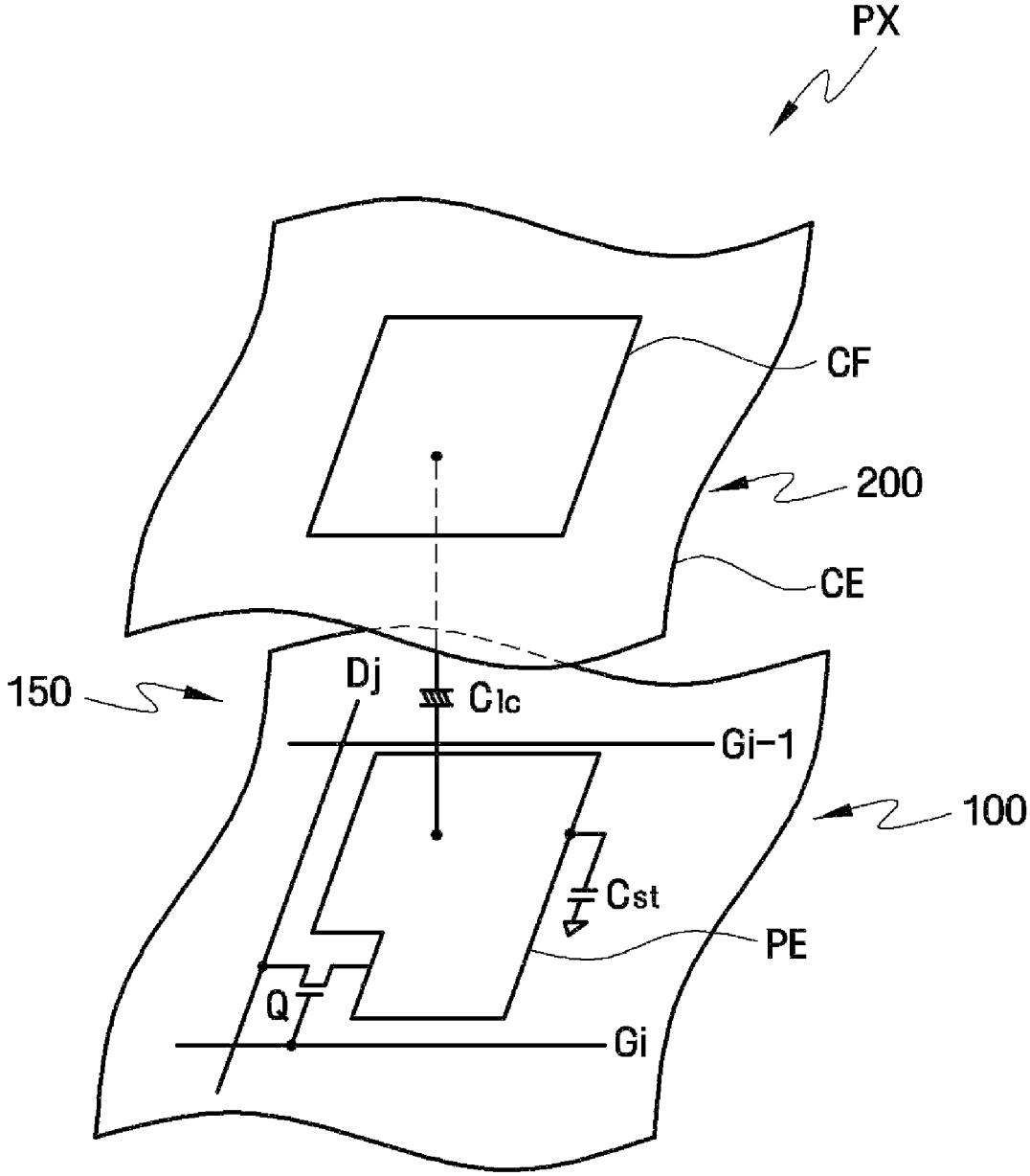
FIG. 2 is an equivalent circuit diagram of a pixel included in a display panel of FIG. 1.

FIG. 1 is a block diagram for explaining a display device 10 and a method of driving the same according to an exemplary embodiment of the present invention. FIG. 2 is an equivalent circuit diagram of a pixel PX included in a display panel 300 of FIG. 1.

Referring to FIG. 1, the display device 10 may include the display panel 300, a signal controller 600, an external memory 800, a gate driver 400, a data driver 500, and a grayscale voltage generator 700.

The display panel 300 includes a plurality of gate lines G1 through G1, a plurality of data lines D1 through Dm, and a plurality of pixels PX. The gate lines G1 through G1 extend substantially in a row direction to be almost parallel to each other, and the data lines D1 through Dm extend substantially in a column direction to be almost parallel to each other. Each pixel PX is defined by a region in which each gate lines G1 through G1 and each data line D1 through Dm cross each other. The gate driver 400 transmits a plurality of gate signals to the gate lines G1 through G1, respectively, and the data driver 500 transmits a plurality of image data voltages to the data lines D1 through Dm, respectively. The pixels PX display images in response to the image data voltages, respectively.

As will be described later, the signal controller 600 may output a corrected image signal RGB_DCC to the data driver 500, and the data driver 500 may output an image data voltage corresponding to the corrected image signal RGB_DCC. Since each pixel PX included in the display panel 300 displays an image in response to a corresponding image data voltage, the display panel 300 may ultimately display an image corresponding to the corrected image signal RGB_DCC.

The display panel 300 may include a plurality of display blocks DB (see FIG. 7), each having a plurality of pixels PX arranged in a matrix. The display blocks DB will be described in detail below with reference to FIG. 7.

As described above, FIG. 2 is an equivalent circuit diagram of one pixel PX. Referring to FIG. 2, the pixel PX is connected to, for example, an $i^{th}$ (i=1 to 1) gate line Gi and a $j^{th}$ (j−1 to m) data line Dj. The pixel PX includes a switching device Q, which is connected to the $i^{th}$ gate line Gi and the $j^{th}$ data line Dj, and a liquid crystal capacitor Clc and a storage capacitor Cst, which are connected to the switching device Q. As shown in FIG. 2, the liquid crystal capacitor Clc may include two electrodes, for example, a pixel electrode PE of a first display panel 100 and a common electrode CE of a second display panel 200, and liquid crystal molecules 150, which are interposed between the pixel electrode PE and the common electrode CE. A color filter CF is formed on a portion of the common electrode CE. In FIG. 2, the color filter CF is formed on the second substrate 200 having the common electrode CE. However, the present invention is not limited thereto, the color filter CF and the common electrode CE may also be formed on the first substrate 100.

Referring back to FIG. 1, the signal controller 600 receives an original image signal RGB_org and external control signals for controlling the display of the original image signal RGB_org and outputs the corrected image signal RGB_DCC, a gate control signal CONT1, and a data control signal CONT2. Here, the corrected image signal RGB_DCC is a signal obtained by correcting the original image signal RGB_org using data read from the external memory 800. Specifically, the original image signal RGB_org may be converted into a transient image signal RGB_itp (see FIG. 3), and then the transient image signal RGB_itp may be corrected to produce the corrected image signal RGB_DCC.

In addition, the transient image signal RGB_itp may be obtained by inserting an interpolated frame between two successive frames of the original image signal RGB_org. As will be described with reference to FIG. 4, the original image signal RGB_org may have a first frequency of, for example, 60 Hz, or a second frequency of, for example, 24 Hz. In addition, each of the transient image signal RGB_itp and the corrected image signal RGB_DCC may have a frame frequency of, for example, 120 Hz.

Specifically, the signal controller 600 may receive the original image signal RGB_org and output the corrected image signal RGB_DCC. The signal controller 600 may also receive external control signals from an external source and generate the gate control signal CONT1 and the data control signal CONT2. Examples of the external control signals include a vertical synchronization signal Vsync, a horizontal synchronization signal Hsync, a main clock signal Mclk, and a data enable signal DE. The gate control signal CONT1 is used to control the operation of the gate driver 400, and the data control signal CONT2 is used to control the operation of the data driver 500. The signal controller 600 will be described in more detail below with reference to FIG. 3.

Figure 3:
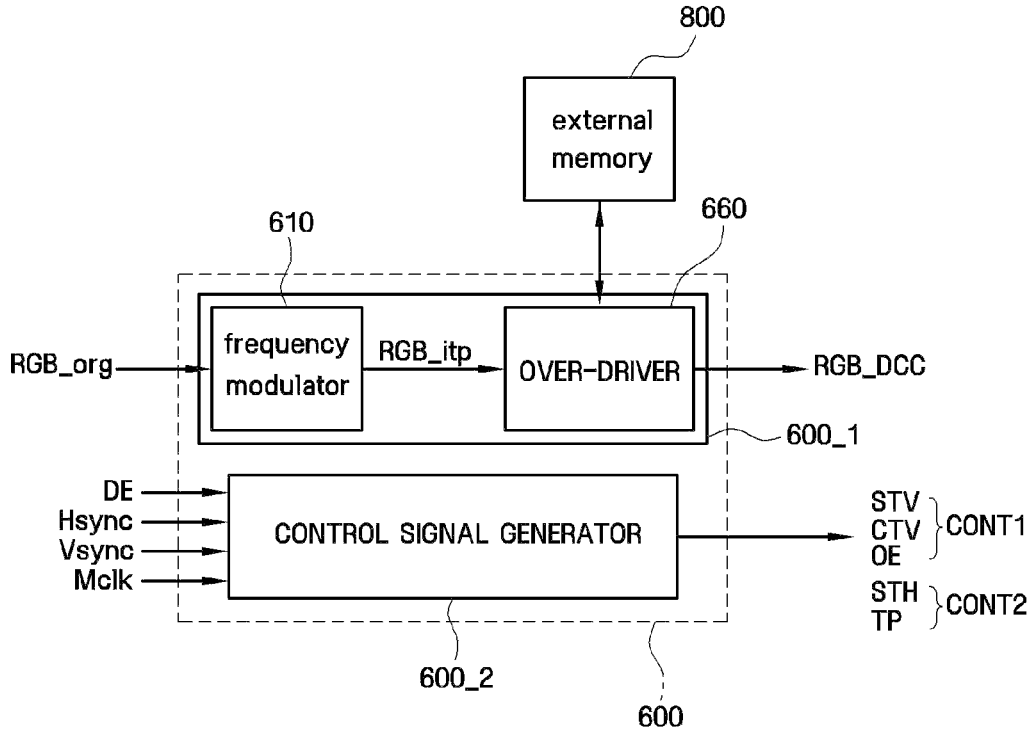
FIG. 3 is a block diagram of a signal controller shown in FIG. 1.

The external memory 800 may store image information of each frame of the transient image signal RGB_itp (see FIG. 3). The signal controller 600 may read image information of an $(n-1)^{th}$ frame of the transient image signal RGB_itp from the external memory 800 and output the corrected image signal RGB_DCC, which is obtained by correcting an $n^{th}$ frame of the transient image signal RGB_itp based on the read image information. This operation will be described below with reference to FIG. 8.

The gate driver 400 may receive the gate control signal CONT1 from the signal controller 600 and transmit a gate signal to each of the gate lines G1 through G1. Here, the gate signal includes a gate-on voltage Von and a gate-off voltage Voff, which are provided by a gate on/off voltage generator (not shown).

The data driver 500 may receive the data control signal CONT2 from the signal controller 600 and apply an image data voltage, which corresponds to the corrected image signal RGB_DCC, to each data line D1 through Dm. The image data voltage, which corresponds to the corrected image signal RGB_DCC, may be provided by the grayscale voltage generator 700.

The grayscale voltage generator 700 may divide a driving voltage AVDD into a plurality of image data voltages based on the gray level of the corrected image signal RGB_DCC and provide the image data voltages to the data driver 500. The grayscale voltage generator 700 may include a plurality of resistors connected in series between a node, to which the driving voltage AVDD is applied, and a ground source. Thus, the grayscale voltage generator 700 may divide the level of the driving voltage AVDD and generate a plurality of grayscale voltages. The internal circuit of the grayscale voltage generator 700 may be implemented in various ways besides that described above.

FIG. 3 is a block diagram of the signal controller 600 shown in FIG. 1. Referring to FIG. 3, the signal controller 600 may include an image signal processor 600_1 and a control signal generator 600_2.

The image signal processor 600_1 may correct the original image signal RGB_org and output the corrected image signal RGB_DCC. Specifically, the image signal processor 600_1 may convert the original image signal RGB_org into the transient image signal RGB_itp and then correct the transient image signal RGB_itp to the corrected image signal RGB_DCC.

The image signal processor 600_1 may include a frequency modulator 610 and an over-driver 660.

The frequency modulator 610 converts the original image signal RGB_org into the transient image signal RGB_itp. The original image signal RGB_org may have a first frequency or a second frequency, which is different from the first frequency, and the transient image signal RGB_itp may have a third frequency, which is higher than the first and second frequencies. The transient image signal RGB_itp may be an image signal obtained by inserting motion-compensated interpolated frames between original frames in order to improve display quality. The frequency modulator 610 will be described in more detail below with reference to FIG. 4, FIG. 5*a*, and FIG. 5*b*.

The over-driver 660 may correct the transient image signal RGB_itp to the corrected image signal RGB_DCC and output the corrected image signal RGB_DCC. The over-driver 660 may read the image information of the $(n-1)^{th}$ frame of the transient image signal RGB_itp from the external memory 800, correct the $n^{th}$ frame of the transient image signal RGB_itp based on the read image information, and output the corrected image signal RGB_DCC. The over-driver 660 will be described in more detail below with reference to FIG. 8.

The control signal generator 600_2 may receive the external control signals from an external source and output the gate control signal CONT1 and the data control signal CONT2. The gate control signal CONT1 is used to control the operation of the gate driver 400. The gate control signal CONT1 may include a vertical start signal STV for starting the gate driver 400, a gate clock signal CTV for determining when to output the gate-on voltage Von, and an output enable signal OE for determining the pulse width of the gate-on voltage Von. The data control signal CONT2 is used to control the operation of the data driver 500. The data control signal CONT2 may include a horizontal start signal STH for starting the data driver 500 and an output instruction signal TP for instructing the output of an image data voltage.

Figure 4:
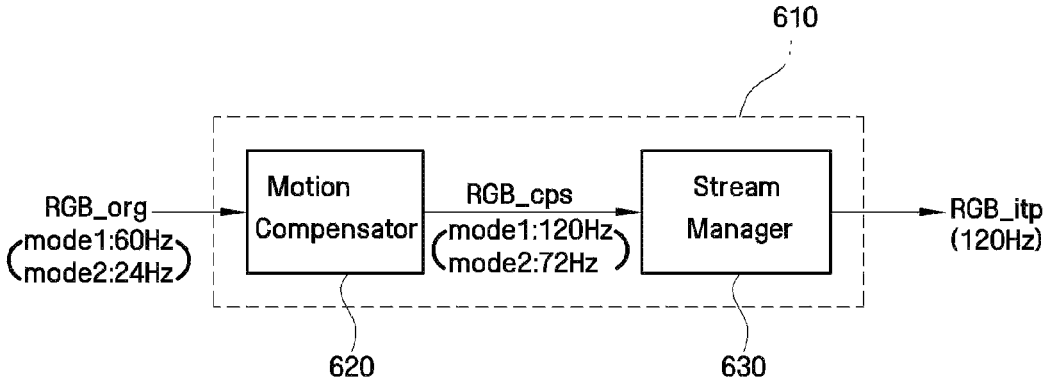
FIG. 4 is a block diagram of a frequency modulator shown in FIG. 3.

FIG. 4 is a block diagram of the frequency modulator 610 shown in FIG. 3. In FIG. 4, the frequency modulator 610 operates in a first mode or a second mode according to the frequency of the original image signal RGB_org. Specifically, FIG. 4 illustrates a case where the frequency modulator 610 operates in the first mode when the original image signal RGB_org has the first frequency of, for example, 60 Hz, and operates in the second mode when the original image signal RGB_org has the second frequency of, for example, 24 Hz. However, the present invention is not limited thereto.

Referring to FIG. 4, the frequency modulator 610 may include a motion compensator 620 and a stream manager 630.

The motion compensator 620 may insert at least one interpolated frame into two successive frames of the original image signal RGB_org and output an interpolated signal RGB_cps. The stream manager 630 may process the interpolated image signal RGB_cps to have the third frequency. That is, the stream manager 630 may process the interpolated image signal RGB_cps and output the transient image signal RGB_itp having the third frequency. In FIG. 4, the third frequency is 120 Hz. However, the present invention is not limited thereto.

Figure 5A:
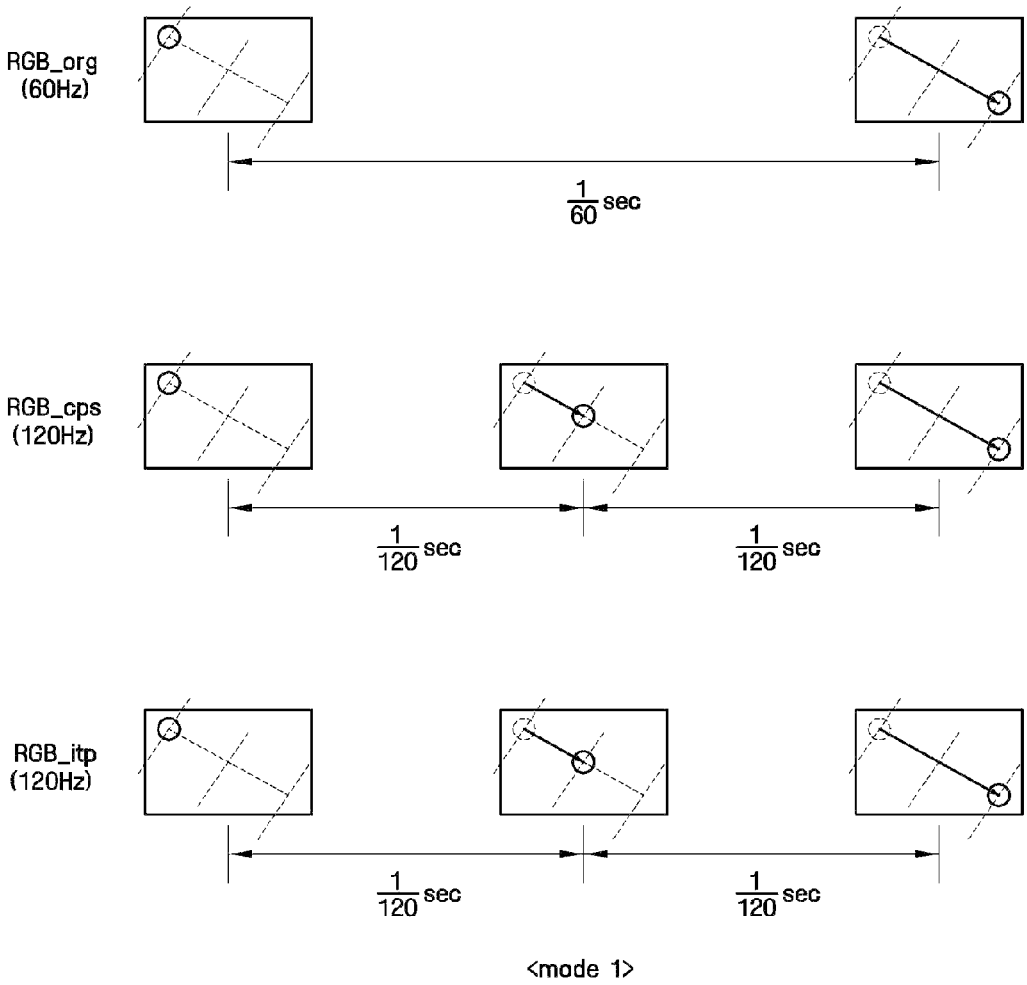
FIG. 5A and FIG. 5B are conceptual diagrams for explaining the image signal processing operations of the frequency modulator of FIG. 4 when in first and second modes, respectively.
Figure 5B:
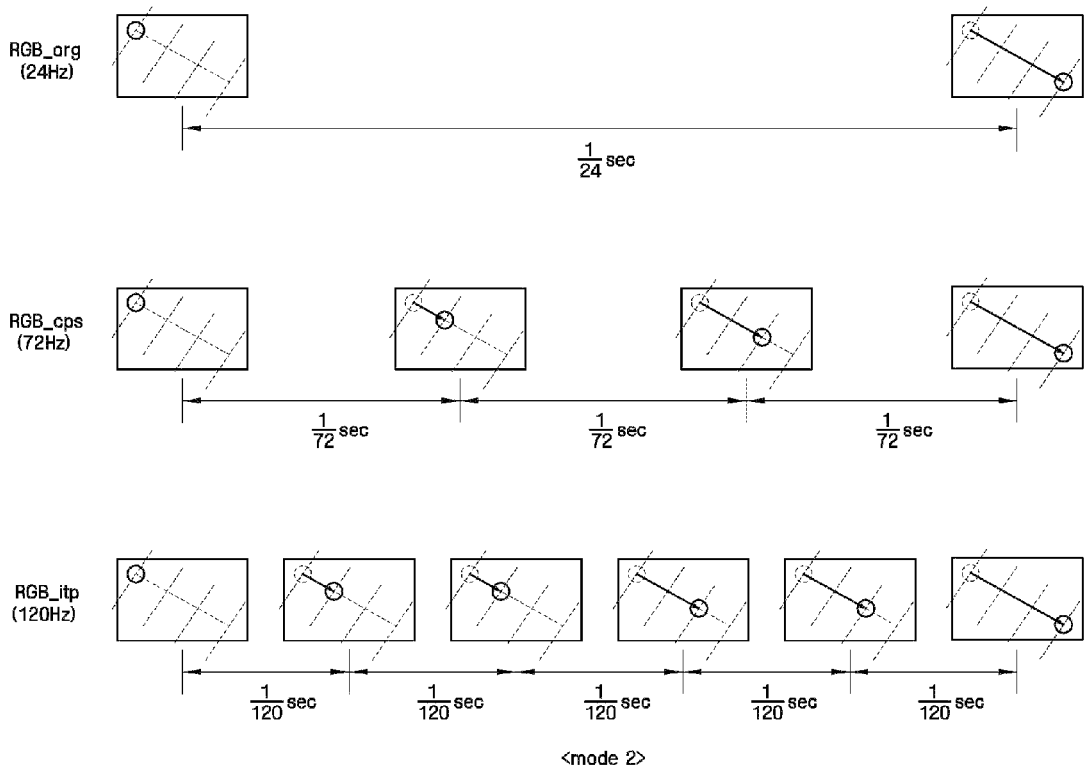

The operations of the frequency modulator 610 in the first and second modes will now be described in detail with reference to FIG. 4, FIG. 5*a*, and FIG. 5*b*. FIG. 5*a* and 5*b* are conceptual diagrams for explaining the image signal processing operations of the frequency modulator 610 when in the first and the second modes, respectively.

The frequency modulator 610 may receive the original image signal RGB_org whose frame frequency is the first frequency or the second frequency, which is different from the first frequency, and output the transient image signal RGB_itp having the third frequency, which is higher than the first and second frequencies.

In the first mode, when the original image signal RGB_org has the first frequency of 60 Hz, for example, the original image signal RGB_org includes frames which are placed at intervals of 1/60 seconds. Here, the motion compensator 620 may insert one interpolated frame between two successive frames of the original image signal RGB_org and output the interpolated image signal RGB_cps having a frequency of 120 Hz. That is, the interpolated image signal RGB_cps may include frames which are placed at intervals of 1/120 seconds. The stream manager 630 may process the interpolated image signal RGB_cps to have the third frequency and output the transient image signal RGB_itp having the third frequency. However, since the interpolated image signal RGB_cps already has the third frequency, i.e., 120 Hz, the stream manager 630 may output the interpolated image signal RGB_cps unchanged.

In the second mode, when the original image signal RGB_org has the second frequency of 24 Hz, for example, the original image signal RGB_org includes frames which are placed at intervals of 1/24 seconds. Here, the motion compensator 620 may insert two interpolated frames between two successive frames of the original image signal RGB_org and output the interpolated image signal RGB_cps having a frequency of 72 Hz. That is, the interpolated image signal RGB_cps may include frames which are placed at intervals of 1/72 seconds. The stream manager 630 may process the interpolated image signal RGB_cps to have the third frequency and output the transient image signal RGB_itp having the third frequency.

Specifically, the stream manager 630 may redundantly insert the two interpolation frames, which have already been inserted into the original image signal RGB_org, into the interpolated image signal RGB_cps and output the transient image signal RGB_itp having the third frequency. For example, referring to FIG. 5*b*, the stream manager 630 may redundantly insert the two interpolated frames generated by the motion compensator 620 into the interpolated image signal RGB_cps and output the transient image signal RGB_itp having the third frequency. Thus, the transient image signal RGB_itp, which is obtained by redundantly inserting the two interpolated frames into the interpolated image signal RGB_cps having the frequency of 72 Hz, may include frames placed at intervals of 1/120 seconds.

Figure 6:
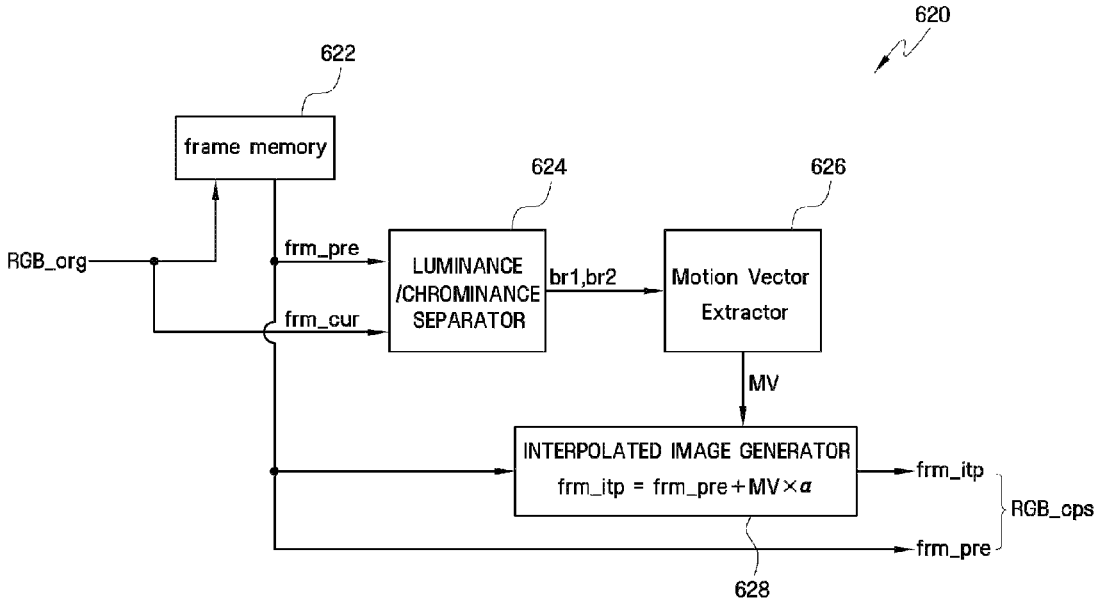
FIG. 6 is a block diagram of a motion compensator shown in FIG. 4.

FIG. 6 is a block diagram of the motion compensator 620 shown in FIG. 4. Referring to FIG. 6, the motion compensator 620 may compare two successive frames, that is, previous and current frames frm_pre and frm_cur of the original image signal RGB_org, extract a motion vector MV, assign a weight a to the extracted motion vector MV, and generate an interpolated frame frm_itp.

The motion compensator 620 may include a frame memory 622, a luminance/chrominance separator 624, a motion vector extractor 626, and an interpolated image generator 628.

The frame memory 622 may store image information of each frame of the original image signal RGB_org. The luminance/chrominance separator 624 and the interpolated image generator 628 may read image information of the previous frame frm_pre from the frame memory 622, generate the interpolated frame frm_itp by using the read image information, and output the interpolated image signal RGB_cps into which the interpolated frame frm_itp is inserted.

The luminance/chrominance separator 624 may separate each of an image signal of the previous frame frm_pre and an image signal of the current frame frm_cur into a luminance component br1 or br2 and a chrominance component (not shown). A luminance component of an image signal has brightness information, and a chrominance component thereof has color information.

The motion vector extractor 626 may compare the previous frame frm_pre with the current frame frm_cur and calculate the motion vector MV of the same object. For example, the motion vector extractor 626 may be provided with the luminance component br1 of the image signal of the previous frame frm_pre and the luminance component br2 of the image signal of the current frame frm_cur and thereby calculate the motion vector MV of the same object.

A motion vector is a physical quantity that represents the motion of an object contained in an image. The motion vector extractor 626 may analyze the luminance component br1 of the image signal of the previous frame frm_pre and the luminance component br2 of the image signal of the current frame frm_cur and determine that the same object is displayed in a region of the previous frame frm_pre and a corresponding region of the current frame frm_cur that have the most matching luminance distributions. Based on the motion of the object between the previous frame frm_pre and the current frame frm_cur, the motion vector extractor 626 may extract the motion vector MV, which will be described in more detail below with reference to FIG. 7.

The interpolated image generator 628 may assign the weight a to the motion vector MV and generate the interpolated frame frm_itp. The interpolated image generator 628 may read the previous frame frm_pre from the frame memory 622 and receive the motion vector MV from the motion vector extractor 626. Then, the interpolated image generator 628 may assign the motion vector MV having the weight a to an object of the previous frame frm_pre and estimate the object in the interpolated frame frm_itp.

Figure 7:
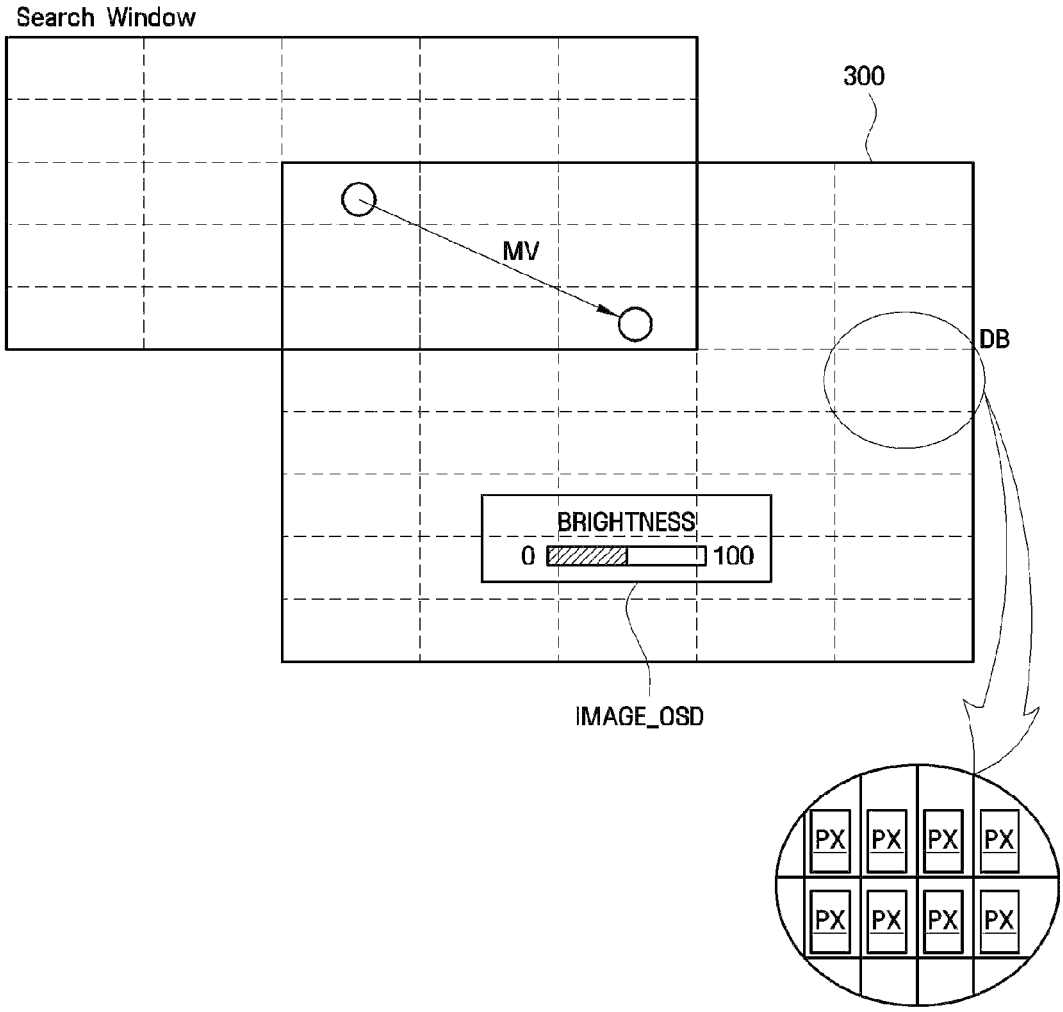
FIG. 7 is a conceptual diagram for explaining the process of calculating a motion vector by using a motion vector extractor shown in FIG. 6.

FIG. 7 is a conceptual diagram for explaining the process of calculating the motion vector MV by using the motion vector extractor 626 shown in FIG. 6.

Referring to FIG. 7, as described above, the display panel 300 may include a plurality of display blocks DB, each having a plurality of pixels PX arranged in a matrix. That is, the display panel 300 may be divided into a plurality of display blocks DB as indicated by dotted lines in FIG. 7, and each of the display blocks DB may include a plurality of pixels PX.

The motion vector extractor 626 (see FIG. 6) may detect the same object by comparing an original image signal of the previous frame frm_pre, which corresponds to each of the display blocks DB, with a original image signal of the current frame frm_cur. In order to detect the same object in the previous frame frm_pre and the current frame frm_cur, the sum of absolute difference (SAD) method may be used. SAD is a method of adding absolute values of luminance differences between matching pixels PX and determining those of the display blocks DB, which have the smallest sum of the absolute values, as matching blocks. Since the SAD method is widely disclosed, a detailed description thereof will be omitted.

In each search window, matching blocks of the previous frame frm_pre and the current frame frm_cur may be determined. That is, for each search window that includes some of the display blocks DB of the display panel 300, the same object may be detected in the previous frame frm_pre and the current frame frm_cur.

In FIG. 7, a circular object and an on-screen display (OSD) image IMAGE_OSD are detected as the same object in the previous frame frm_pre and the current frame frm_cur. Here, the motion vector MV of the circular object is indicated by an arrow, and the OSD image IMAGE_OSD is an example of a stationary object or character. The motion vector MV of the stationary object or character between the previous frame frm_pre and the current frame frm_cur is zero. Since the OSD image IMAGE_OSD is widely disclosed, a detailed description thereof will be omitted.

Figure 8:
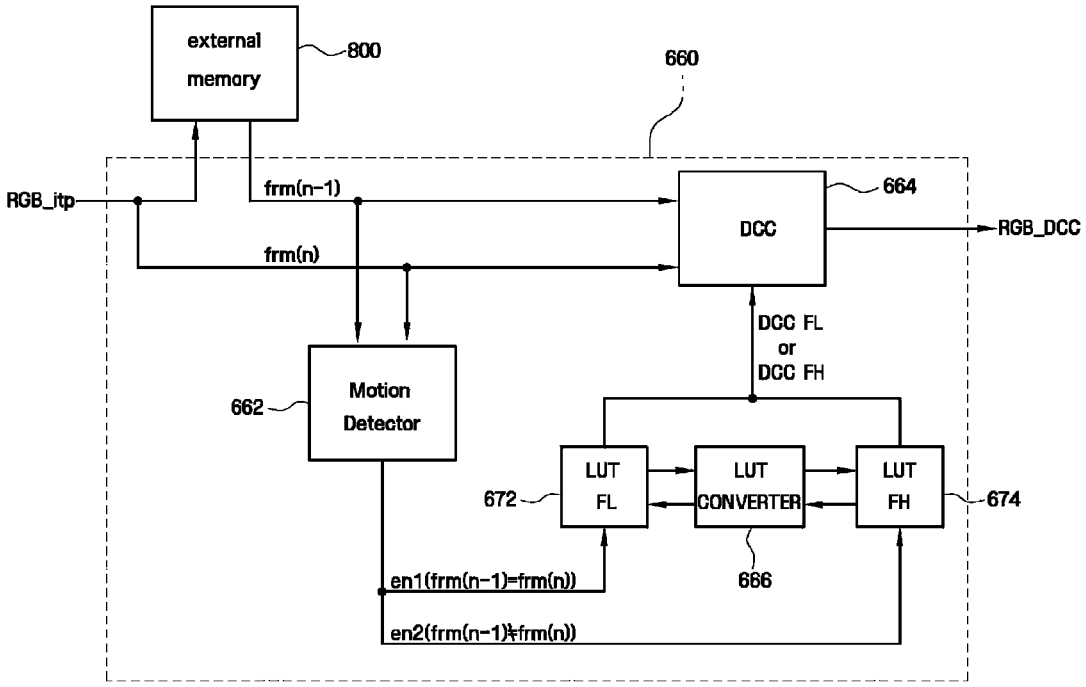
FIG. 8 is a block diagram of an over-driver shown in FIG. 3.
Figure 9:
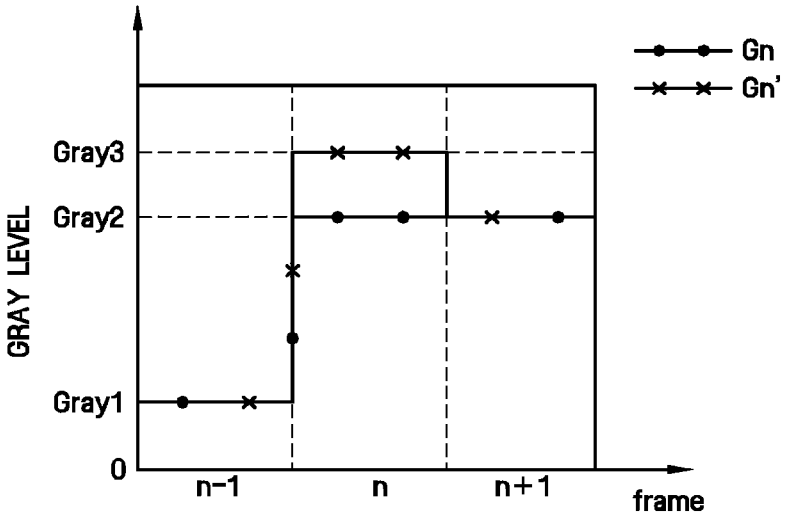
FIG. 9 is a graph for explaining image correction data provided by a lookup table (LUT) selected in FIG. 8.

FIG. 8 is a block diagram of the over-driver 660 shown in FIG. 3. FIG. 9 is a graph for explaining image correction data provided by a lookup table (LUT) selected in FIG. 8.

Referring to FIG. 8, the over-driver 660 may include an LUT converter 666, an internal memory (not shown), a motion detector 662, and a dynamic capacitance compensator (DCC) 664. The internal memory may store a second LUT (i.e., any one of a low-frequency LUT 672 (LUT FL) and a high-frequency LUT 674 (LUT FH)) generated from a first LUT table (i.e., the other one of the low-frequency LUT 672 and the high-frequency LUT 674). The motion detector 662 may enable any one of the low-frequency LUT 672 and the high-frequency LUT 674. The DCC 664 may correct the transient image signal RGB_itp by using a selected LUT (i.e., the low-frequency LUT 672 or the high-frequency LUT 674).

Specifically, the LUT converter 666 may generate the second LUT table (i.e., any one of the low-frequency LUT 672 and the high-frequency LUT 674) from the first LUT table (i.e., the other one of the low-frequency LUT 672 and the high-frequency LUT 674). Although not shown in FIG. 8, the first LUT may be stored in an external memory (not shown) that is disposed outside the image signal processor 600_1 (see FIG. 3). For example, the first LUT may be stored in an electrically erasable programmable read-only memory (EEPROM) which is disposed outside the image signal processor 600_1. On the other hand, the second LUT generated by the LUT converter 666 may be stored in an internal memory (not shown) included in the image signal processor 600_1. That is, the LUT converter 666 may load the first LUT (i.e., any one of the low-frequency LUT 672 and the high-frequency LUT 674) from the external memory, convert the first LUT into the second LUT (i.e., the other one of the low-frequency LUT 672 and the high-frequency LUT 674), and store the generated second LUT in the internal memory.

In FIG. 8, any one of the low-frequency LUT 672, which corresponds to a low frequency, and the high-frequency LUT 674, which corresponds to a high frequency, may be the first LUT, and the other one of the same may be the second LUT. Specifically, the external memory may store the low-frequency LUT 672, and the LUT converter 666 may convert the low-frequency LUT 672 into the high-frequency LUT 674. In this case, the low-frequency LUT 672 may be the first LUT, and the high-frequency LUT 674 may be the second LUT. On the contrary, the external memory may store the high-frequency LUT 674, and the LUT converter 666 may convert the high-frequency LUT 674 into the low-frequency LUT 672. In this case, the high-frequency LUT 674 may be the first LUT, and the low-frequency LUT 672 may be the second LUT.

The low-frequency LUT 672 and the high-frequency LUT 674 store image correction data that corresponds to an $(n-1)^{th}$ frame frm(n−1) and an $n^{th}$ frame frm(n). When the second frequency is higher than the first frequency, the low-frequency LUT 672 may store image correction data DCC FL, which corresponds to the original image signal RGB_org having the first frequency. In addition, the high-frequency LUT 674 may store image correction data DCC FH, which corresponds to the original image signal RGB_org having the second frequency.

The motion detector 662 may output a first enable signal en1 or a second enable signal en2, which enable any one of the low-frequency LUT 672 and the high-frequency LUT 674, according to the frame frequency of the original image signal RGB_org. The first enable signal en1 may enable the low-frequency LUT 672, and the second enable signal en2 may enable the high-frequency LUT 674.

When the second frequency is higher than the first frequency, if the original image signal RGB_org has the first frequency, the motion detector 662 may output the first enable signal en1, which enables the low-frequency LUT 672. If the original image signal RGB_org has the second frequency, the motion detector 662 may output the second enable signal en2, which enables the high-frequency LUT 674.

The motion detector 662 may read the $(n-1)^{th}$ frame frm (n−1) of the transient image signal RGB_itp from the external memory 800. Then, the motion detector 662 may enable any one of the low-frequency LUT 672 and the high-frequency LUT 674 according to whether the $n^{th}$ frame frm(n) of the transient image signal RGB_itp is identical to the read $(n-1)^{th}$ frame frm(n−1) of the transient image signal RGB_itp.

When the second frequency is higher than the first frequency, if the $(n-1)^{th}$ frame frm(n−1) and the $n^{th}$ frame frm(n) of the transient image signal RGB_itp are identical to each other, the motion detector 662 may select the low-frequency LUT 672. On the contrary, when the second frequency is higher than the first frequency and the $(n-1)^{th}$ frame frm(n−1) and the $n^{th}$ frame frm(n) of the transient image signal RGB_itp are different from each other, the motion detector 662 may select the high-frequency LUT 674.

The original image signal RGB_org may not be converted into the transient image signal RGB_itp. Instead, the original image signal RGB_org may be directly corrected to the corrected image signal RGB_DCC, unlike the illustration in the drawing. In this case, the motion detector 662 may operate as follows. The motion detector 662 may compare the previous and current frames frm_pre and frm_cur of the original image signal RGB_org and output the first enable signal en1 or the second enable signal en2, which enable any one of the low-frequency LUT 672 and the high-frequency LUT 674, according to whether the previous frame frm_pre and the current frame frm_cur of the original image signal RGB_org are identical to each other. If the previous and current frames frm_pre and frm_cur of the original image signal RGB_org are identical, the motion detector 662 may output the first enable signal en1. If they are different, the motion detector 662 may output the second enable signal en2.

The DCC 664 may correct the transient image signal RGB_itp by using a selected LUT (i.e., the low-frequency LUT 672 or the high-frequency LUT 674) and thus reduce the response time of liquid crystals. The DCC 664 may receive and correct the $(n-1)^{th}$ frame frm(n−1) and the $n^{th}$ frame frm(n) of the transient image signal RGB_itp and output the corrected image signal RGB_DCC.

FIG. 9 illustrates a gray level Gn of an image signal of each frame and a gray level Gn' of the image signal after being corrected in order to explain image correction data provided by a selected LUT. The image signal before being corrected may be the transient image signal RGB_itp or the original image signal RGB_org.

Referring to FIG. 9, when the gray level Gn of the original image signal RGB_org of an $n^{th}$ frame is higher than that of the original image signal RGB_org of an $(n-1)^{th}$ frame, the gray level Gn' of the corrected image signal of the $n^{th}$ frame may be higher than or equal to the gray level Gn of the original image signal RGB_org of the $n^{th}$ frame. Alternatively, although not shown in the drawing, when the gray level Gn of the original image signal RGB_org of the $n^{th}$ frame is lower than that of the original image signal RGB_org of the $(n-1)^{th}$ frame, the gray level Gn' of the corrected image signal of the $n^{th}$ frame may be lower than or equal to the gray level Gn of the original image signal RGB_org of the $n^{th}$ frame.

In FIG. 9, the gray level Gn of the image signal before being corrected significantly changes at the $n^{th}$ frame. That is, the image signal before being corrected has a first gray level G1 at the $(n-1)^{th}$ frame and has a second gray level G2, which is higher than the first gray level G1, at the $n^{th}$ frame and an $(n+1)^{th}$ frame. At the $n^{th}$ frame, the corrected image signal has a higher gray level than the image signal before being corrected. That is, the corrected image signal has the first gray level G1 and the second gray level G2 at the $(n-1)^{th}$ frame and the $(n+1)^{th}$ frame, respectively, and has a third gray level G3, which is higher than the second gray level G2, at the $n^{th}$ frame.

When the over-driver 660 provides the corrected image signal having the third gray level G3, which is higher than the second gray level G2, at the $n^{th}$ frame as described above, a greater image data voltage can be applied to the liquid crystal capacitor Clc of FIG. 2 than when the over-driver 660 provides the original image signal RGB_org. The greater the image data voltage that is applied to the liquid crystal capacitor Clc, the shorter the time required to charge the liquid crystal capacitor Clc with the image data voltage. That is, as the image data voltage increases, the response time of liquid crystal molecules is reduced, thereby improving display quality.

Figure 10:
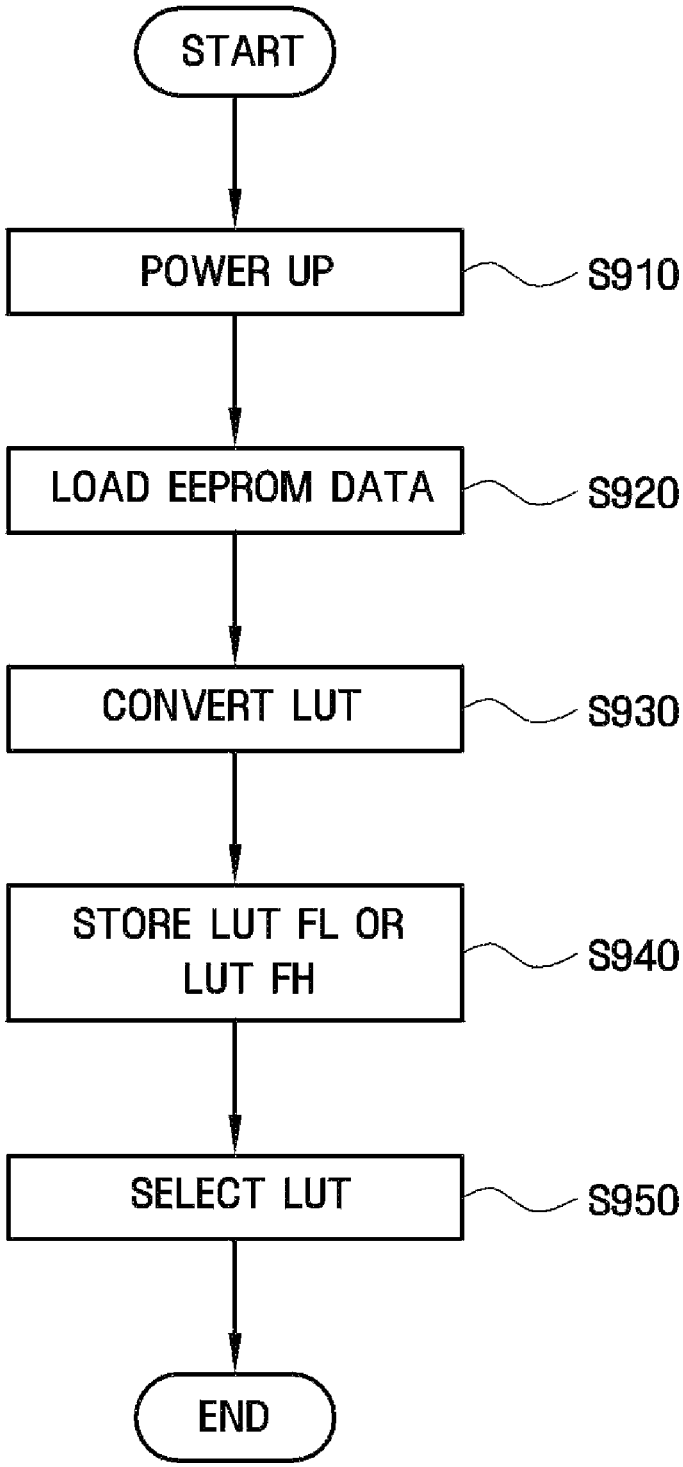
FIG. 10 is a flowchart illustrating a method of driving a display device according to an exemplary embodiment of the present invention.

Hereinafter, a method of driving the display device 10 (see FIG. 1) according to an exemplary embodiment of the present invention will be described in detail with reference to FIG. 3 and FIG. 10. FIG. 10 is a flowchart illustrating a method of driving the display device 10 of FIG. 1 according to an exemplary embodiment of the present invention.

Referring to FIG. 3 and FIG. 10, the display device 10 (see FIG. 1) is powered on (operation S910). Then, the first LUT, which stores correction data that corresponds to the original image signal RGB_org having the first frequency, is loaded (operation S920).

Specifically, when the display device 10 is powered on, the over-driver 660 of the signal controller 600 may load the first LUT from the external memory 800. Here, if the display device 10 is to convert the original image signal RGB_org into the transient image signal RGB_itp and then correct the transient image signal RGB_itp to the corrected image signal RGB_DCC, the first LUT may store correction data that corresponds to the transient image signal RGB_itp having the first frequency.

Next, the second LUT, which corresponds to the original image signal RGB_org having the second frequency, is generated from the loaded first LUT (operation S930). Here, the over-driver 660 of the signal controller 600 may convert the first LUT into the second LUT.

Next, the second LUT is stored in the internal memory (not shown) of the image signal processor 600_1 (operation S940). If the display device 10 is to convert the original image signal RGB_org into the transient image signal RGB_itp and then correct the transient image signal RGB_itp into the corrected image signal RGB_DCC, the second LUT may store correction data that corresponds to the transient image signal RGB_itp having the second frequency.

The first or second LUT is selected based on the frame frequency of the original image signal RGB_org, and the original image signal RGB_org is corrected by using the selected LUT to output the corrected image signal RGB_DCC (operation S950).

Here, if the display device 10 is to convert the original image signal RGB_org into the transient image signal RGB_itp and correct the transient image signal RGB_itp to the corrected image signal RGB_DCC, the first or second LUT may be selected based on the frame frequency of the transient image signal RGB_itp, and the transient image signal RGB_itp may be corrected by using the selected LUT to output the corrected image signal RGB_DCC.

Figure 11:
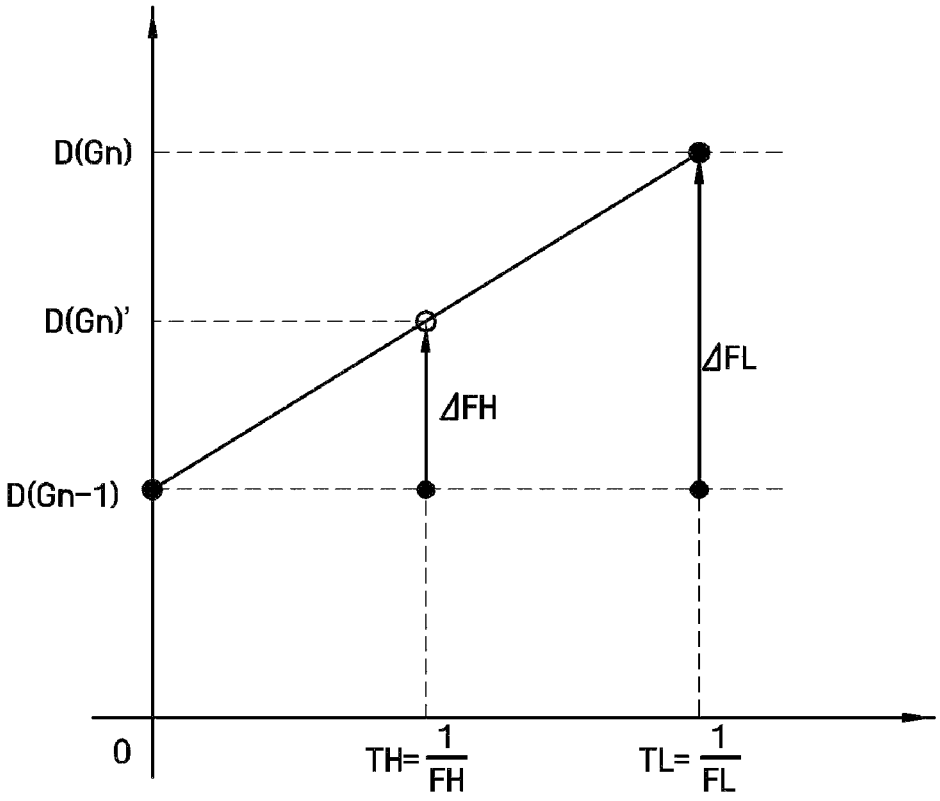
FIG. 11 is graph for explaining an interpolation process for converting a first LUT, which corresponds to a first frequency, into a second LUT which corresponds to a second frequency higher than the first frequency.
Figure 12:
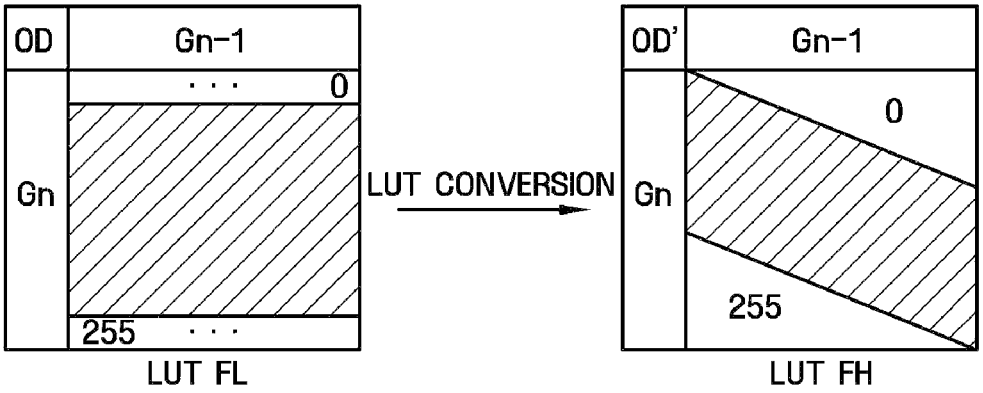
FIG. 12 is a conceptual diagram illustrating the process of converting the first LUT into the second LUT through the interpolation process of FIG. 11.

The process of generating the second LUT, which corresponds to the second frequency higher than the first frequency, based on the first LUT, which corresponds to the first frequency, will now be described in detail with reference to FIG. 11 and FIG. 12. That is, the process of converting the low-frequency LUT 672 (see FIG. 8) into the high-frequency LUT 674 (see FIG. 8) when the first LUT is the low-frequency LUT 672 and the second LUT is the high-frequency LUT 674 will be described. FIG. 11 is graph for explaining an interpolation process for converting the first LUT, which corresponds to the first frequency, into the second LUT, which corresponds to the second frequency that is higher than the first frequency. FIG. 12 is a conceptual diagram illustrating the process of converting the first LUT into the second LUT through the interpolation process of FIG. 11.

In FIG. 11, a low frame frequency, that is, the first frequency, is indicated by reference character FL, and a high frame frequency, that is, the second frequency, is indicated by reference character FH. The time required for the arrangement of liquid crystal molecules to be changed according to the gray level of an image signal when the frame frequency is low, that is, the transition time of the liquid crystal molecules at the first frequency is indicated by reference character TL. In addition, the time required for the arrangement of the liquid crystal molecules to be changed according to the gray level of the image signal when the frame frequency is high, that is, the transition time of the liquid crystal molecules at the second frequency is indicated by reference character TH.

The transition time TL of the liquid crystal molecules at the first frequency is 1/FL, and the transition time TH of the liquid crystal molecules at the second frequency is 1/FH. Thus, a ratio of the transition time TH of the liquid crystal molecules at the second frequency to the transition time TL of the liquid crystal molecules at the first frequency is FL/FH.

Referring to FIG. 11 and FIG. 12, when image correction data OD (Gn−1, Gn) corresponds to a gray level D(Gn−1) of an $(n-1)^{th}$ frame and a gray level D(Gn) of an $n^{th}$ frame in the low-frequency LUT (LUT FL) 672, image correction data having the same value as the image correction data OD(Gn−1, Gn) may correspond to the gray level D(Gn−1) and a gray level D(Gn)', which is lower than the gray level D(Gn), in the high-frequency LUT 674 (LUT FH).

Specifically, when the gray level D(Gn−1) is increased to the gray level D(Gn) by using the image correction data OD(Gn−1, Gn) at the low frequency FL, the gray level D(Gn−1) may be increased to the gray level D(Gn)' by using the same image correction data OD(Gn−1, Gn) at the high frequency FH. Here, the gray level D(Gn)' may be calculated as follows. For simplicity, it will be assumed that the difference ΔFL between the gray levels D(Gn) and D(Gn−1) at the low frequency FL and the difference ΔFH between the gray levels D(Gn) and D(Gn−1) at the high frequency FH has a linear relationship. Based on this assumption, the following equation is established.

$$(D(Gn)-D(Gn-1))\times FL/FH+D(Gn-1)=(1-FL/FH)\times D(Gn-1)+FL/FH\times D(Gn) \quad (1).$$

That is, the gray level D(Gn)' is the sum of (1−FL/FH)×D(Gn−1) and FL/FH×D(Gn). Based on the above relationship, the first LUT, which is the low-frequency LUT 672 (LUT FL), may be converted into the second LUT, which is the high-frequency LUT 674 (LUT FH) as shown in FIG. 12.

Specifically, the first LUT, that is, the low-frequency LUT 672 (LUT FL) may be used as it is However, each image correction data OD(Gn−1, Gn) of the low-frequency LUT 672 (LUT FL) may be mapped to correspond to the gray level D(Gn)' of the second LUT. As a result, the second LUT, that is, the high-frequency LUT (LUT FH) 674, may be obtained. Then, each image correction data OD(Gn−1, Gn) of the low-frequency LUT 672 (LUT FL) is mapped to that of the high-frequency LUT 674 (LUT FH) as indicated by hatched lines in FIG. 12.

In this case, no image correction data of the low-frequency LUT 672 is mapped to a lower left corner and an upper right corner of the high-frequency LUT 674. Thus, the upper right and the lower left corners of the high-frequency LUT 674 may be filled with the lowest gray level and the highest gray level, respectively, to complete the high-frequency LUT 674 (LUT FH). In FIG. 12, the lowest gray level is zero, and the highest gray level is 255.

Figure 13:
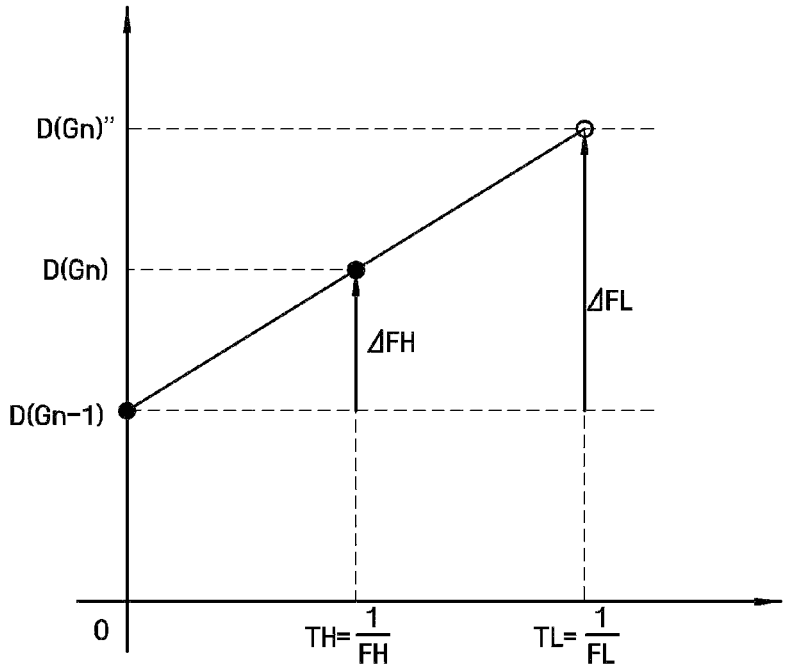
FIG. 13 is graph for explaining an extrapolation process for converting the first LUT, which corresponds to the first frequency, into the second LUT which corresponds to the second frequency lower than the first frequency.
Figure 14:
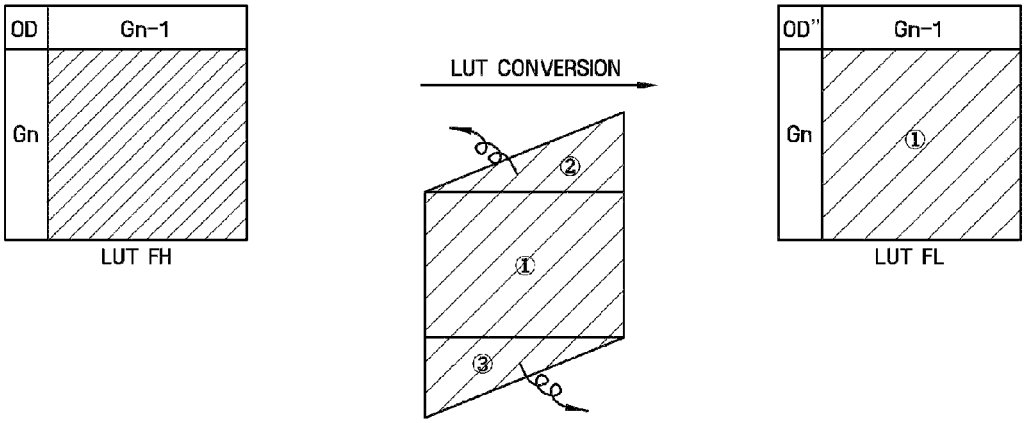
FIG. 14 is a conceptual diagram illustrating the process of converting the first LUT into the second LUT through the extrapolation process of FIG. 13.

The process of generating the second LUT, which corresponds to the second frequency lower than the first frequency, based on the first LUT, which corresponds to the first frequency, will now be described in detail with reference to FIG. 13 and FIG. 14. That is, the process of converting the high-frequency LUT 674 (see FIG. 8) into the low-frequency LUT 672 (see FIG. 8) when the first LUT is the high-frequency LUT 674 and the second LUT is the low-frequency LUT 672 will be described. FIG. 13 is a graph for explaining an extrapolation process for converting the first LUT, which corresponds to the first frequency, into the second LUT, which corresponds to the second frequency that is lower than the first frequency. FIG. 14 is a conceptual diagram illustrating the process of converting the first LUT into the second LUT through the extrapolation process of FIG. 13.

In FIG. 13, a high frame frequency, that is, the first frequency, is indicated by reference character FH, and a low frame frequency, that is, the second frequency, is indicated by reference character FL. The transition time of liquid crystal molecules when the frame frequency is high, that is, at the first frequency, is indicated by reference character TH. In addition, the transition time of the liquid crystal molecules when the frame frequency is low, that is, at the second frequency, is indicated by reference character TL.

The transition time TH of the liquid crystal molecules at the first frequency is 1/FH, and the transition time TL of the liquid crystal molecules at the second frequency is 1/FL. Thus, a ratio of the transition time TL of the liquid crystal molecules at the second frequency to the transition time TH of the liquid crystal molecules at the first frequency is FH/FL.

Referring to FIG. 13 and FIG. 14, when image correction data OD (Gn−1, Gn) corresponds to a gray level D(Gn−1) of an $(n-1)^{th}$ frame and a gray level D(Gn) of an $n^{th}$ frame in the high-frequency LUT (LUT FH) 674, image correction data having the same value as the image correction data OD(Gn−1, Gn) may correspond to the gray level D(Gn−1) and a gray level D(Gn)", which is higher than the gray level D(Gn), in the low-frequency LUT 672 (LUT FL).

Specifically, when the gray level D(Gn−1) is increased to the gray level D(Gn) by using the image correction data OD(Gn−1, Gn) at the high frequency FH, the gray level D(Gn−1) may be increased to the gray level D(Gn)" by using the same image correction data OD(Gn−1, Gn) at the low frequency FL. Here, the gray level D(Gn)" may be calculated as follows. For simplicity, it will be assumed that the difference ΔFH between the gray levels D(Gn) and D(Gn−1) at the high frequency FH and the difference ΔFL between the gray levels D(Gn) and D(Gn−1) at the low frequency FL have a linear relationship. Based on this assumption, the following equation can be established.

$$(D(Gn)-D(Gn-1))\times FH/FL+D(Gn-1)=(1-FH/FL)\times D(Gn-1)+FH/FL\times D(Gn) \quad (2).$$

That is, the gray level D(Gn)" is the sum of (1−FH/FL)×D(Gn−1) and FH/FL×D(Gn). Based on the above relationship, the first LUT which is the low-frequency LUT 674 (LUT FH) may be converted into the second LUT which is the low-frequency LUT 672 (LUT FL) as shown in FIG. 14.

Specifically, the first LUT, that is, the high-frequency LUT 674 (LUT FH) may be used as it is. However, each image correction data OD(Gn−1, Gn) of the high-frequency LUT 674 (LUT FH) may be mapped to correspond to the gray level D(Gn)" of the second LUT. As a result, the second LUT, that is, the low-frequency LUT (LUT FL) 672, may be obtained. Then, each image correction data OD(Gn−1, Gn) of the high-frequency LUT 674 (LUT FH) is mapped to that of the low-frequency LUT 672 (LUT FL) as indicated by hatched lines in FIG. 14.

When the high-frequency LUT 674 (LUT FH) is converted into the low-frequency LUT 672 (LUT FL), part of the image correction data OD(Gn−1, Gn) of the high-frequency LUT 674 is mapped to regions ② and ③ outside the second LUT, i.e., the low-frequency LUT 672. If the image correction data OD(Gn−1, Gn) existing in the regions ② and ③ is discarded, only a region ① remains as shown in FIG. 14.

Meanwhile, unmapped regions in the second LUT, that is, vacant spaces in the region ① of FIG. 14, may be filled with values interpolated from the mapped image correction data OD(Gn−1, Gn) to complete the low-frequency LUT 672 (LUT FL).

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display device, comprising:

an image signal processor configured to correct an original image signal whose frame frequency is a first frequency or a second frequency different from the first frequency and configured to output a corrected image signal;

a first lookup table configured to store image correction data corresponding to an (n−1)-th frame and an n-th frame that correspond to the original image signal having the first frequency; and a display panel configured to display an image corresponding to the corrected image signal, wherein a second lookup table, which corresponds to the original image signal having the second frequency, is generated from the first lookup table, and the first lookup table or the second lookup table is selected based on the frame frequency of the original image signal to output the corrected image signal.

2. The display device of claim 1, wherein, when the second frequency is higher than the first frequency and when image correction data OD(Gn−1, Gn) corresponds to a gray level D(Gn−1) of the (n−1)-th frame and a gray level D(Gn) of the n-th frame in the first lookup table, image correction data having the same value as the image correction data OD(Gn−1, Gn) corresponds to the gray level D(Gn−1) and a gray level D(Gn)', which is lower than the gray level D(Gn), in the second lookup table.

3. The display device of claim 2, wherein the image correction data OD(Gn−1, Gn) of the first lookup table is mapped to correspond to the gray level D(Gn)' of the second lookup table, and an upper right corner and a lower left corner of the second lookup table are filled with a lowest gray level and a highest gray level, respectively.

4. The display device of claim 2, wherein, when the first frequency and the second frequency are FL and FH, respectively, the gray level D(Gn)' is the sum of (1−FL/FH)×D(Gn−1) and FL/FH×D(Gn).

5. The display device of claim 1, wherein, when the second frequency is lower than the first frequency and when the image correction data OD(Gn−1, Gn) corresponds to the gray level D(Gn−1) of the (n−1)-th frame and the gray level D(Gn) of the n-th frame in the first lookup table, image correction data having the same value as the image correction data OD(Gn−1, Gn) corresponds to the gray level D(Gn−1) and a gray level D(Gn)", which is higher than the gray level D(Gn), in the second lookup table.

6. The display device of claim 5, wherein the image correction data OD(Gn−1, Gn) of the first lookup table is mapped to correspond to the gray level D(Gn)" of the second lookup table, the image correction data OD(Gn−1, Gn) existing in regions outside the second lookup table is discarded, and unmapped regions in the second lookup table are filled with values interpolated from the image correction data OD(Gn−1, Gn).

7. The display device of claim 5, wherein, when the first frequency and the second frequency are FH and FL, respectively, the gray level D(Gn)' is the sum of (1−FH/FL)×D(Gn−1) and FH/FL×D(Gn).

8. The display device of claim 1, wherein, when the frame frequency is the second frequency, the image signal processor is further configured to select the second lookup table.

9. The display device of claim 1, wherein, when a gray level of the n-th frame is higher than that of the (n−1)-th frame, the image correction data is higher than or equal to the gray level of the n-th frame, and, when the gray level of the n-th frame is lower than that of the (n−1)-th frame, the image correction data is lower than or equal to the gray level of the n-th frame.

10. A display device comprising:

an image signal processor configured to, convert an original image signal, whose frame frequency is a first frequency or a second frequency different from the first frequency, into a transient image signal having a third frequency that is higher than the first frequency and the second frequency, correct the transient image signal, and output a corrected image signal;

a first lookup table configured to store image correction data corresponding to an (n−1)-th frame and an n-th frame of the original image signal having the first frequency; and a display panel configured to display an image corresponding to the corrected image signal, wherein a second lookup table, which corresponds to the original image signal having the second frequency, is generated from the first lookup table, and the first lookup table or the second lookup table is selected based on the frame frequency of the original image signal to output the corrected image signal.

11. The display device of claim 10, wherein the image signal processor comprises:

a frequency modulator configured to convert the original image signal into the transient image signal; and an over-driver configured to correct the transient image signal to the corrected image signal and output the corrected image signal.

12. The display device of claim 11, wherein the frequency modulator comprises:

a motion compensator configured to insert one or more interpolated frames between two successive frames of the original image signal; and a stream manager configured to process the original image signal having the interpolated frames inserted thereto to have the third frequency.

13. The display device of claim 11, wherein the image signal processor is further configured to select the first lookup table or the second lookup table according to whether an (n−1)-th frame and an n-th frame of the transient image signal are identical to each other.

14. The display device of claim 13, wherein, when the second frequency is higher than the first frequency and when the (n−1)-th frame and the n-th frame of the transient image signal are identical to each other, the image signal processor being further configured to select the first lookup table.

15. A method of driving a display device comprising an image signal processor, the method comprising:

receiving an original image signal whose frame frequency is a first frequency or a second frequency different from the first frequency;

loading a first lookup table when the display device is powered on, the first lookup table storing image correction data corresponding to an (n−1)-th frame and an n-th frame of the original image signal having the first frequency;

generating a second lookup table, which corresponds to the original image signal having the second frequency, from the first lookup table;

storing the second lookup table in an internal memory of the image signal processor;

selecting the first lookup table or the second lookup table based on the frame frequency of the original image signal and generating a corrected image signal by using the selected lookup table; and displaying an image that corresponds to the corrected image signal.

16. The method of claim 15, wherein the first lookup table is stored in an electrically erasable programmable read-only memory (EEPROM) that is disposed outside the image signal processor.

17. The method of claim 15, wherein, when the second frequency is higher than the first frequency and when image correction data OD(Gn−1, Gn) corresponds to a gray level D(Gn−1) of the (n−1)-th frame and a gray level D(Gn) of the n-th frame in the first lookup table, image correction data having the same value as the image correction data OD(Gn−1, Gn) corresponds to the gray level D(Gn−1) and a gray level D(Gn)', which is lower than the gray level D(Gn), in the second lookup table.

18. The method of claim 17, wherein, when the first frequency and the second frequency are FL and FH, respectively, the gray level D(Gn)' is the sum of (1−FL/FH)×D(Gn−1) and FL/FH×D(Gn).

19. The method of claim 15, wherein, when the second frequency is lower than the first frequency and when the image correction data OD(Gn−1, Gn) corresponds to the gray level D(Gn−1) of the (n−1)-th frame and the gray level D(Gn) of the n-th frame in the first lookup table, image correction data having the same value as the image correction data OD(Gn−1, Gn) corresponds to the gray level D(Gn−1) and a gray level D(Gn)', which is higher than the gray level D(Gn), in the second lookup table.

20. The method of claim 19, wherein, when the first frequency and the second frequency are FH and FL, respectively, the gray level D(Gn)' is the sum of (1−FH/FL)×D(Gn−1) and FH/FL×D(Gn).

* * * * *